US008795571B2

(12) United States Patent
Bryl et al.

(10) Patent No.: US 8,795,571 B2
(45) Date of Patent: Aug. 5, 2014

(54) DUAL OPERATION DE-CURLER

(75) Inventors: Derek A. Bryl, Webster, NY (US); Adam D. Ledgerwood, Geneva, NY (US); Aaron M. Moore, Fairport, NY (US); Matthew M. Storey, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 602 days.

(21) Appl. No.: 13/037,644

(22) Filed: Mar. 1, 2011

(65) Prior Publication Data

US 2012/0223116 A1 Sep. 6, 2012

(51) Int. Cl.
*B29C 53/18* (2006.01)

(52) U.S. Cl.
USPC ..... 264/280

(58) Field of Classification Search
USPC ..... 264/280, 288.4
See application file for complete search history.

(56) References Cited

U.S. PATENT DOCUMENTS

| | | | | |
|---|---|---|---|---|
| 2,737,089 | A * | 3/1956 | Baumgartner | 162/271 |
| 3,072,051 | A * | 1/1963 | Lincoln et al. | 101/227 |
| 3,135,448 | A * | 6/1964 | Wilson | 26/80 |
| 3,185,616 | A * | 5/1965 | Woythal et al. | 162/271 |
| 3,546,067 | A * | 12/1970 | Heidepriem | 162/271 |
| 3,558,254 | A | 1/1971 | Cahill | |
| 3,649,447 | A * | 3/1972 | Turner, Lyman | 162/271 |
| 3,670,645 | A * | 6/1972 | Hill | 101/181 |
| 3,884,623 | A * | 5/1975 | Slack | 432/60 |
| 4,475,896 | A * | 10/1984 | Bains | 493/454 |
| 4,494,394 | A | 1/1985 | Nilsson | |
| 4,517,042 | A * | 5/1985 | Singer | 156/164 |
| 4,605,458 | A * | 8/1986 | Nakamura | 156/164 |
| 5,009,749 | A * | 4/1991 | Cederholm et al. | 162/271 |
| 5,201,514 | A * | 4/1993 | Rebres | 271/188 |
| 5,414,503 | A * | 5/1995 | Siegel et al. | 399/406 |
| 6,032,004 | A | 2/2000 | Mirabella, Jr. et al. | |
| 6,423,423 | B2 | 7/2002 | Akutsu et al. | |
| 6,668,155 | B1 * | 12/2003 | Hubble et al. | 399/406 |
| 2004/0216502 | A1 | 11/2004 | Chung et al. | |
| 2007/0248396 | A1 * | 10/2007 | Blanchard et al. | 400/619 |
| 2008/0247796 | A1 * | 10/2008 | Johnston et al. | 399/406 |
| 2010/0175331 | A1 | 7/2010 | Piri | |

FOREIGN PATENT DOCUMENTS

| | | |
|---|---|---|
| JP | 60052459 | 3/1985 |

* cited by examiner

*Primary Examiner* — Matthew Daniels
(74) *Attorney, Agent, or Firm* — Gibb & Riley, LLC

(57) ABSTRACT

Methods and devices control a de-curling apparatus. A roll of material is fed through a nip formed between a first roller having a concave shape and a second roller contacting the first roller. The second roller has a convex shape mirroring the concave shape. The methods and devices automatically and continually adjust the amount of pressure applied at the nip between the first roller and the second roller as the material is unrolled from the roll into the nip.

16 Claims, 2 Drawing Sheets

DUAL OPERATION DE-CURLER

BACKGROUND

Embodiments herein generally relate to de-curling methods and devices and more particularly to those that utilize concave/convex rollers and that vary the pressure and speed between the rollers to achieve optimal de-curling performance.

Many times it is necessary to impart or remove curl from a material in order to process in the material more easily. For example, devices that transport sheets of media (such as copiers, printers, multifunction machines, etc.) often benefit from very flat de-curled sheets, which reduces the occurrence of jamming and other malfunctions. Similarly, when ribbons or webs of material are unwound from rolls, they may contain a certain amount of curl that needs to be removed.

Common devices that impart or remove curl can generally utilize pairs of rollers (note that sometimes rollers are referred to as rolls). One of the rollers is more elastic (softer) than the other roller. Pressure is applied between the rollers to form what is referred to as a "nip" and the material to be curled or de-curled is fed through the nip to have the curl removed or added.

Some forms of media can contain curl in two different directions, a lengthwise curl and a widthwise curl. This is often caused when laminated strips are stored on rolls. Such materials can have a widthwise curl caused by different coefficients of expansion of the different materials within the laminate structure. In addition, the materials can include a lengthwise curl corresponding to the curvature of the center of the roll. When media contains curls in multiple directions, conventional de-curlers need to perform multiple processes and use multiple structures to remove each of these different curls.

SUMMARY

One exemplary method herein controls a de-curling apparatus. A roll of material is fed through a nip formed between a first roller having a concave shape and a second roller contacting the first roller. The second roller has a convex shape mirroring the concave shape. The first roller and the second roller have different coefficients of elasticities.

The method automatically and continually adjusts the amount of pressure applied at the nip between the first roller and the second roller as the material is unrolled from the roll into the nip.

The method can monitor the amount of curl present in the material as the material reaches the nip and control the process of adjusting the pressure according to the amount of curl present in the material. The method can determine the current radius of the roll or the amount of material remaining on the roll as the material is unrolled from the roll into the nip to monitor the amount of curl.

Another exemplary method of controlling a de-curling apparatus also feeds a roll of material through a nip (formed between a first roller having a concave shape and a second roller contacting the first roller). The second roller again has a convex shape mirroring the concave shape. This method automatically and continually adjusts the relative rotational speed of the first roller and the second roller as the material is unrolled from the roll into the nip. By changing the relative speed between the first roller and the second roller, the method changes the lateral location on surfaces of the first roller and the second roller where there is no slippage between the first roller and the second roller.

An additional embodiment herein comprises a de-curling apparatus that includes a first roller having a concave shape, a second roller contacting the first roller (the second roller having a convex shape mirroring the concave shape), an actuator operatively connected to the first roller and/or the second roller, and a controller operatively connected to the actuator. The actuator changes positions of the first roller and the second roller relative to each other.

A nip is formed between the first roller and the second roller. The nip changes the curl characteristic of the material fed from the roll through the nip. The controller automatically and continually adjusts the amount of pressure applied at the nip between the first roller and the second roller using the actuator as the material is unrolled from the roll into the nip. Thus, the controller monitors the amount of curl present in the material as the material reaches the nip and adjusts the pressure being applied to the nip based on the amount of curl present in the material.

Another exemplary de-curling apparatus herein also has a first roller having a concave shape, a second roller contacting the first roller (the second roller again having a convex shape mirroring the concave shape), an actuator operatively connected to the first roller and/or the second roller, and a controller operatively connected to the actuator. Here, the actuator controls rotational speeds of the first roller and/or the second roller.

Again, a nip is formed between the first roller and the second roller, and the nip again changes the curl characteristic of material fed from the roll of the material through the nip. The controller automatically and continually adjusts the relative rotational speeds of the first roller and the second roller using the actuator as the material is unrolled from the roll into the nip.

In this embodiment, the controller monitors the amount of curl present in the material as the material reaches the nip. When the controller changes the relative speed between the first roller and the second roller, this changes the lateral location on the surfaces of the first roller and the second roller where there is no slippage between the first roller and the second roller.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, some forms of media contains curls in multiple directions. Further, the amount of curl can change as the material is removed from the roll. This variation in curl amount is due to the fact that the material is sometimes stored by wrapping it around a center roll. The material that feeds out initially tends to be flatter than and the material that feeds out later, as this later material was stored with a tighter wrap angle around the center of the roll.

In order to address these situations, the embodiments herein provide a dual de-curling nip that de-curls material as it is unrolled from a roll and that minimizes marks made on the material. For de-curling the strips along the length, the combination of a solid roller, a compliant roller, and pressure removes the lengthwise curl. The higher the pressure applied at the nip, the more the strip will be de-curled along its length. The embodiments herein vary the pressure to increase the de-curling amount as the lengthwise curl increases (because of the spool diameter change in an emptying roll).

Thus, in one example, the pressure between the rollers is increased continuously to correlate with and counteract the ever-tightening curl radius in the roll of material. When a new roll is used, the pressure resets back to its initial de-curling setting and once again begins to increase as more material is removed from the roll.

Figure 1:
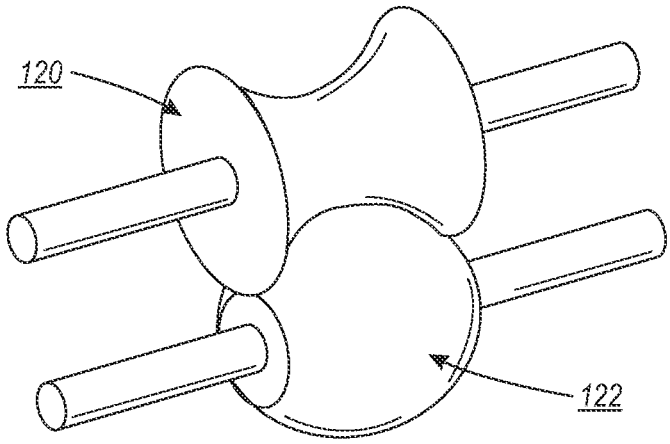
FIG. 1 is a side-view schematic diagram of a device according to embodiments herein.

As shown in FIG. 1, the nips utilized with the embodiments herein include a set of concave/convex rollers 120, 122 that mirror each other, creating a U-shape profile, which de-curls the material along its width. Further, the embodiments herein minimize the amount of marks made on the media being decurled by controlling the relative speeds of the rollers. More specifically, by varying the relative speeds of the rollers, the lateral locations at which the curved concave/convex surfaces of do not slide against each other changes along the width of the rollers, which minimizes any marks that may appear on the media being decurled. Some negative effects of relative velocity between the rolls include wear on the rolls, potential steering/tracking issues, and output speed variability. There can be an optimum speed differential for each one of these, which can be fine tuned with independent speed control. Further, the speed differential can be fixed with a mechanical coupling (gear set, etc.) once the optimum ration is determined. One issue with profiling the concave/convex roller pair 120, 122 is the relative motion differential between the two rolls at different points along their width. To control and minimize this slip, the relative rotational speeds of the roller pair is dynamically varied to change to point (lateral location) at which the slip does not occur.

Figure 2:
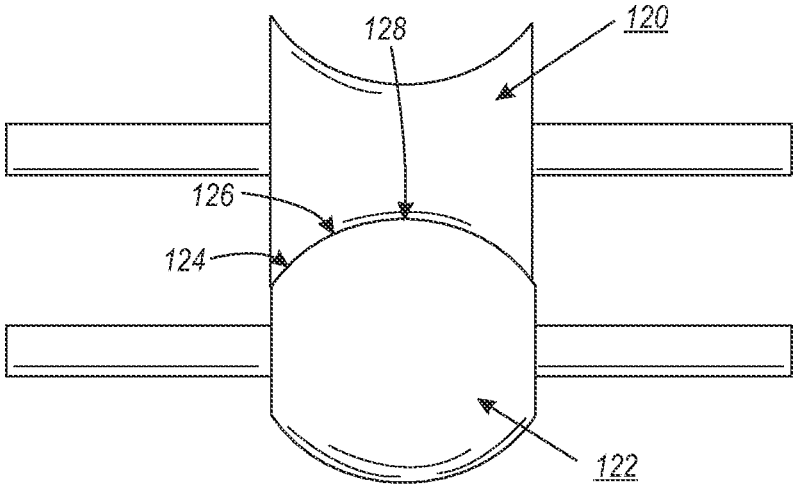
FIG. 2 is a side-view schematic diagram of a device according to embodiments herein.

For example, as shown in FIG. 2, by driving both rolls at the same rpm, point 126 will have no relative motion (same radius, same rpm). However, at points 124 and 128, there will be a relative motion differential. The lateral location (e.g., 124, 126, 128) at which there is no relative motion between the rollers can be changed by making one of the rollers rotate at a faster rate than the other roller rotates. Therefore, this lateral location can be moved more towards the center of the rollers or more towards the outer edges of the rollers by changing the relative rotational rates. Different types of media (having different thicknesses, different curvature amounts, rough, smooth, etc.) can benefit from different lateral locations of no relative motion. As shown below, user input can identify the different types of media, or sensors can automatically detect these different types of media. Once the type of media (or the amount of widthwise curling) is determined, the relative rotational rates of the concave/convex rollers can be adjusted so that the lateral location where there is no relative motion between the rollers is located at a position that is optimal for that type of media or type of curling condition.

Therefore, the embodiments herein provide de-curling that adjusts the pressure and relative roller speed continuously as material is unrolled from the role. This allows the embodiments herein to de-curl the length (via pressure between solid and compliant roll) of the material. Thus, the embodiments herein provide a single device that performs a number of different de-curling operations, which reduces the overall size, weight, and cost of the de-curler device.

Figure 3:
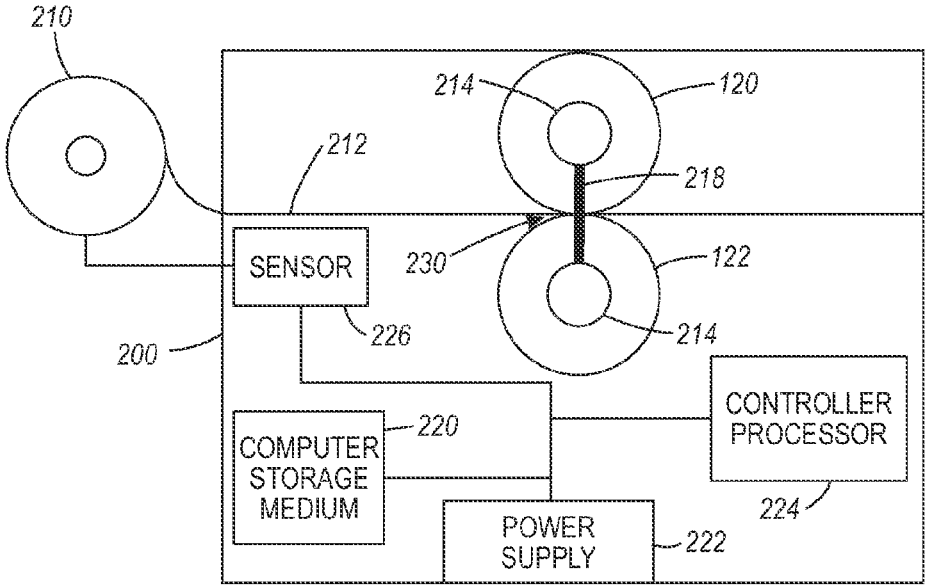
FIG. 3 is a side-view schematic diagram of a device according to embodiments herein.

One exemplary method shown in FIG. 3 comprises a de-curling apparatus 300 that includes a first roller 120 having a concave shape (see FIGS. 1 and 2) and a second roller 122 contacting the first roller 120. As shown in FIGS. 1 and 2, the second roller 122 has a convex shape mirroring the concave shape of the first roller 120. Differently shaped concave/convex rollers (with different radius) can be used to control the amount of decurl. The rollers 120, 122 can be made of any appropriate materials including metals alloys, plastics, ceramics, rubbers, or any other materials. As mentioned above, the first roller 120 and the second roller 122 can have different coefficients of elasticities to promote lengthwise de-curling. The amount of lengthwise de-curling can be controlled by material selection of the rollers and the corresponding differences in the elasticities of the rollers.

A linear actuator 218 is operatively connected to the first roller 120 and/or the second roller 122. The linear actuator 218 can comprise any form of motor (e.g., any motor or actuator herein can be electrically powered, hydraulically powered, pneumatically powered, etc., screw-type, gear-type, belt-type, magnetic type, etc.) that changes positions of the first roller 120 and the second roller 122 relative to each other (e.g., moves the axis of the rollers toward or away from each other).

A controller 224 is operatively connected to the actuator 218. The controller/processor 224 controls the various actions of the device 200. A non-transitory computer storage medium device 220 (which can be optical, magnetic, capacitor based, etc.) is readable by the processor 224 and stores instructions that the processor 224 executes to allow the device 200 to perform its various functions, such as those described herein.

A nip 230 is formed between the first roller 120 and the second roller 122 wherein the media 212 passes. The media or material 212 can be any item that needs to be de-curled including paper and paper products, transparencies, plastics, metals, alloys, etc. The nip 230 changes the curl characteristic of the material 212 fed from the roll 210 through the nip 230.

The controller 224 automatically and continually adjusts the amount of pressure applied at the nip 230 between the first roller 120 and the second roller 122 using the linear actuator 218 as the material 212 is unrolled from the roll 210 into the nip 230. Thus, the controller 224 monitors the amount of curl present in the material 212 as the material 212 reaches the nip 230 and adjusts the pressure being applied to the nip 230 based on the amount of curl present in the material 212.

Additionally, rotational actuators 214 control the rotational speeds of the first roller 120 and/or the second roller 122. The controller 224 automatically and continually adjusts the relative rotational speeds of the first roller 120 and the second roller 122 using the actuator 214 as the material 212 is unrolled from the roll 210 into the nip 230. The controller 224 monitors the amount of curl present in the material 212 as the material 212 reaches the nip 230. The adjustment to the relative rotational speed is made to minimize any marks that may appear on the material 212. As discussed above, when the controller 224 changes the relative speed between the first roller 120 and the second roller 122, this changes the lateral location (124, 126, 128) on the surfaces of the first roller 120 and the second roller 122 where there is no slippage between the first roller 120 and the second roller 122.

When monitoring the amount of curl present in the material as the material reaches the nip, the processor 224 can use at least one sensor 226 (optical sensor, tactile sensor, ultrasonic sensor, etc.) to measure curl. Additionally, the processor can determine the current radius of the roll or the amount of material remaining on the roll (again using a sensor 226) as the material is unrolled from the roll into the nip to monitor the amount of curl. As mentioned above, the embodiments herein vary the pressure to increase the de-curling amount as the lengthwise curl increases (because of the spool diameter change in an emptying roll).

Figure 4:
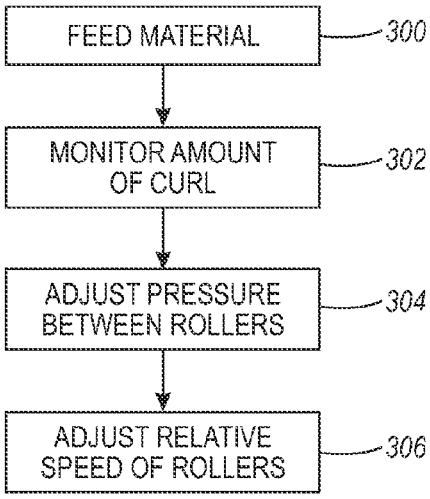
FIG. 4 is flowchart illustrating methods herein.

FIG. 4 is a flowchart illustrating various methods herein that control the de-curling apparatus. As shown in item 300, a roll of material is fed through a nip formed between a first roller having a concave shape and a second roller contacting the first roller. The second roller has a convex shape mirroring the concave shape.

In item 302 the method can monitor the amount of curl present in the material as the material reaches the nip. The method can determine the current radius of the roll or the amount of material remaining on the roll as the material is unrolled from the roll into the nip to monitor the amount of curl or can use a sensor.

In item 304, the method automatically and continually adjusts the amount of pressure applied at the nip between the first roller and the second roller as the material is unrolled from the roll into the nip according to the amount of curl present in the material. Also, in item 306, the method automatically and continually adjusts the relative rotational speed of the first roller and the second roller as the material is unrolled from the roll into the nip. By changing the relative speed between the first roller and the second roller, the method changes the lateral location on surfaces of the first roller and the second roller where there is no slippage between the first roller and the second roller thereby minimizing any marks that may be made on the material.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multifunction machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Automatic means that a process is performed by a machine without further user input.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A de-curling apparatus comprising:

a first roller having a concave shape;

a second roller contacting said first roller, said second roller having a convex shape mirroring said concave shape;

actuators operatively connected to said first roller and said second roller, said actuator actuators changing position said first roller and said second roller relative to each other, and said actuators controlling rotational speeds of said first roller and said second roller to cause said first roller to rotate at a different rotational speed from said second roller and establish a relative rotational speed difference between said first roller and said second roller; and a nip being formed between said first roller and said second roller, at least one sensor that measures the amount of curl present in material that reaches said nip, a controller operatively connected to said actuators and the at least one sensor, said nip changing a curl characteristic of material fed from a roll of said material through said nip, said controller automatically and continually adjusting an amount of pressure applied at said nip between said first roller and said second roller using said actuators based on said amount of curl present in said material as said material is unrolled from said roll into said nip, and said controller automatically and continually adjusting said relative rotational speed difference between said first roller and said second roller using said actuators based on said amount of curl present in said material as said material is unrolled from said roll into said nip.

2. The de-curling apparatus according to claim 1, said controller determining the current radius of said roll as said material is unrolled from said roll into said nip.

3. The de-curling apparatus according to claim 1, said controller determining the amount of material remaining on said roll as said material is unrolled from said roll into said nip.

4. The de-curling apparatus according to claim 1, said first roller and said second roller having different coefficients of elasticities.

5. A de-curling apparatus comprising:

a first roller having a concave shape;

a second roller contacting said first roller, said second roller having a convex shape mirroring said concave shape;

actuators operatively connected to said first roller and said second roller, said actuator actuators controlling rotational speeds of said first roller and said second roller to cause said first roller to rotate at a different rotational speed from said second roller and establish a relative rotational speed difference between said first roller and said second roller; and a nip being formed between said first roller and said second roller, at least one sensor that measures the amount of curl present in material that reaches said nip, a controller operatively connected to said actuators and the at least one sensor, said nip changing a curl characteristic of material fed from a roll of said material through said nip, and said controller automatically and continually adjusting said relative rotational speed difference between said first roller and said second roller using said actuators based on said amount of curl present in said material as said material is unrolled from said roll into said nip.

6. The de-curling apparatus according to claim 5, said controller determining the current radius of said roll as said material is unrolled from said roll into said nip.

7. The de-curling apparatus according to claim 5, said controller determining the amount of material remaining on said roll as said material is unrolled from said roll into said nip.

8. The de-curling apparatus according to claim 5, said controller changing said relative speed between said first roller and said second roller changes a lateral location on surfaces of said first roller and said second roller where there is no slippage between said first roller and said second roller.

9. A de-curling apparatus comprising:

a first roller having a concave shape;

a second roller contacting said first roller, said second roller having a convex shape mirroring said concave shape;

actuators operatively connected to said first roller and said second roller, said actuators changing position said first roller and said second roller relative to each other, and said actuators controlling rotational speeds of said first roller and said second roller to cause said first roller to rotate at a different rotational speed from said second roller and establish a relative rotational speed difference between said first roller and said second roller; and a nip being formed between said first roller and said second roller, said nip changing a curl characteristic of material fed through said nip, at least one sensor that measures the amount of curl present in material that reaches said nip, a controller operatively connected to said actuators and the at least one sensor, said controller automatically and continually adjusting an amount of pressure applied at said nip between said first roller and said second roller using said actuators based on said amount of curl present in said material as said material enters said nip, and said controller automatically and continually adjusting said relative rotational speed difference between said first roller and said second roller using said actuators to dynamically control a lateral location of no relative motion between said first roller and said second roller, based on a location previously established to be optimal for de-curling at least one of: a type of media; and a type of curling condition.

10. The de-curling apparatus according to claim 9, said controller determining the current radius of a roll as said material is unrolled from said roll into said nip.

11. The de-curling apparatus according to claim 9, said controller determining the amount of material remaining on a roll as said material is unrolled from said roll into said nip.

12. The de-curling apparatus according to claim 9, said first roller and said second roller having different coefficients of elasticities.

13. A de-curling apparatus comprising:

a first roller having a concave shape;

a second roller contacting said first roller, said second roller having a convex shape mirroring said concave shape;

actuators operatively connected to said first roller and said second roller, said actuators controlling rotational speeds of said first roller and said second roller to cause said first roller to rotate at a different rotational speed from said second roller and establish a relative rotational speed difference between said first roller and said second roller; and a nip being formed between said first roller and said second roller, at least one sensor that measures the amount of curl present in material that reaches said nip, a controller operatively connected to said actuators and the at least one sensor, said nip changing a curl characteristic of material fed through said nip, and said controller automatically and continually adjusting said relative rotational speed difference between said first roller and said second roller using said actuators based on said amount of curl present in said material to dynamically control a lateral location of no relative motion between said first roller and said second roller, based on a location previously established to be optimal for de-curling at least one of: a type of media; and a type of curling condition.

14. The de-curling apparatus according to claim 13, said controller determining the current radius of a roll as said material is unrolled from said roll into said nip.

15. The de-curling apparatus according to claim 13, said controller determining the amount of material remaining on a roll as said material is unrolled from said roll into said nip.

16. The de-curling apparatus according to claim 13, said controller changing said relative speed between said first roller and said second roller changes a lateral location on surfaces of said first roller and said second roller where there is no slippage between said first roller and said second roller.

* * * * *